United States Patent [19]

Ford, Jr.

[11] 4,313,780

[45] Feb. 2, 1982

[54] ROADWAY STRIPER

[75] Inventor: Jere B. Ford, Jr., Dyersburg, Tenn.

[73] Assignee: Jere B. Ford, Inc., Dyersburg, Tenn.

[21] Appl. No.: 131,686

[22] Filed: Mar. 18, 1980

[51] Int. Cl.[3] ..... B32B 31/00

[52] U.S. Cl. ..... 156/523; 83/649; 156/577; 156/579; 404/94

[58] Field of Search ..... 156/71, 543, 523, 545, 156/577, 579; 404/94; 83/649, 928; 242/86.52

[56] References Cited

U.S. PATENT DOCUMENTS

| | | | |
|---|---|---|---|
| 2,278,948 | 4/1942 | Rudli et al. | 404/94 |
| 3,350,256 | 10/1967 | Eckman et al. | 156/523 |
| 3,393,114 | 7/1968 | Jorgensen | 156/523 |
| 3,472,724 | 10/1969 | Casey | 156/523 |
| 3,483,064 | 12/1969 | McMullen et al. | 156/577 |

*Primary Examiner*—John J. Gallagher

*Attorney, Agent, or Firm*—Dennison, Meserole, Pollack & Scheiner

[57] ABSTRACT

A wheeled machine for applying marking tape in strips to a roadway surface from a spool supply including a manually movable pulling wheel which can be lowered to force the free end of the tape against the roadway surface. A cutting blade moves with the pulling wheel but is only operable to sever the tape, when a stationary cutter bar is moved into position beneath the tape. A finishing wheel on the machine smooths out the applied tape. Controls for the pulling wheel and cutter bar are by a bell crank mounted on the machine handle bars working through a flexible cable.

10 Claims, 9 Drawing Figures

ROADWAY STRIPER

BACKGROUND

The present invention relates generally to the field of roadway striping machines and more specifically to a small, wheeled, hand-pushed unit for laying and cutting adhesive roadway tape. The invention is particularly applicable for use in applying temporary traffic control indicia strips, as for example during roadway paving operations. It is further contemplated that my new striper can be used in large exhibit halls, gymnasiums and the like for laying marking tape to delineate discrete areas for exhibitions, fairs, and similar events.

Most of the known prior art devices are highly sophisticated in structure and operation and are principally designed for applying permanent markings on highways and parking lots. One technique commonly used is to apply a paint stripe to the roadway. Such stripes are very difficult to change when necessary and require periodic repainting due to wear. An alternative approach is to apply an adhesive tape which is precut to a desired width and may incorporate reflective beads therein as well as coloring agents.

Many of the prior art tape applying machines, as exemplified by the Eigenmann U.S. Pat. Nos. 3,844,669; 3,886,011; 3,964,835; 4,071,384; and 4,102,718, teach such machines, however they either first spray an adhesive agent on the roadway surface or apply heat and pressure to a special tape. In the latter of the patents a thermoplastic primer is first melted on the surface and then the tape is applied under pressure to cause penetration of the primer into the roadway surface. It will be readily apparent that the equipment used by Eigenmann is complex, heavy and expensive.

Stenemann U.S. Pat. No. 4,030,958 shows another form of tape applicator in a towed vehicle wherein the tape travels over a number of rolls or guides in a serpentine path. A timer is also used in this arrangement for precise length control. Such sophistication is neither necessary nor desired in a light-weight machine for application of temporary tape traffic controls.

SUMMARY AND OBJECTS OF THE INVENTION

My new roadway striper utilizes a light-weight, three-wheeled framework which may be pushed by the operator with very little effort. Temporary adhesive tape is fed off of a supply spool on the front of the frame to the roadway where it is initially pressed onto the surface by a vertically movable pulling wheel. Thereafter a trailing finishing wheel presses the tape intimately into contact with the surface. At the end of a strip the pulling wheel which carries a cutting blade at the rear thereof is lowered onto the tape and cooperates with a cutter bar which is moved into position beneath the tape to shear the same. All controls are by bell crank levers located on the framework handles.

It is a principal object of this invention to provide a light-weight hand-pushed roadway striper for applying temporary control tape to a roadway surface.

A further object of my invention is to provide a simple inexpensive roadway striper which can be used by untrained personnel, and which is safe and efficient in use and inexpensive to manufacture.

Another object of the invention is to provide a hand-propelled roadway striper wherein all operating controls for initially starting the tape, cutting strips to proper length, and restarting the tape are incorporated into cranks mounted on the handles.

These and other objects of the invention will become apparent upon inspection of the detailed drawings and specification which follow which represent only a preferred embodiment of my invention. Other modifications and uses will be apparent to those skilled in the art.

DRAWINGS

DESCRIPTION OF PREFERRED EMBODIMENT

Figure 1:
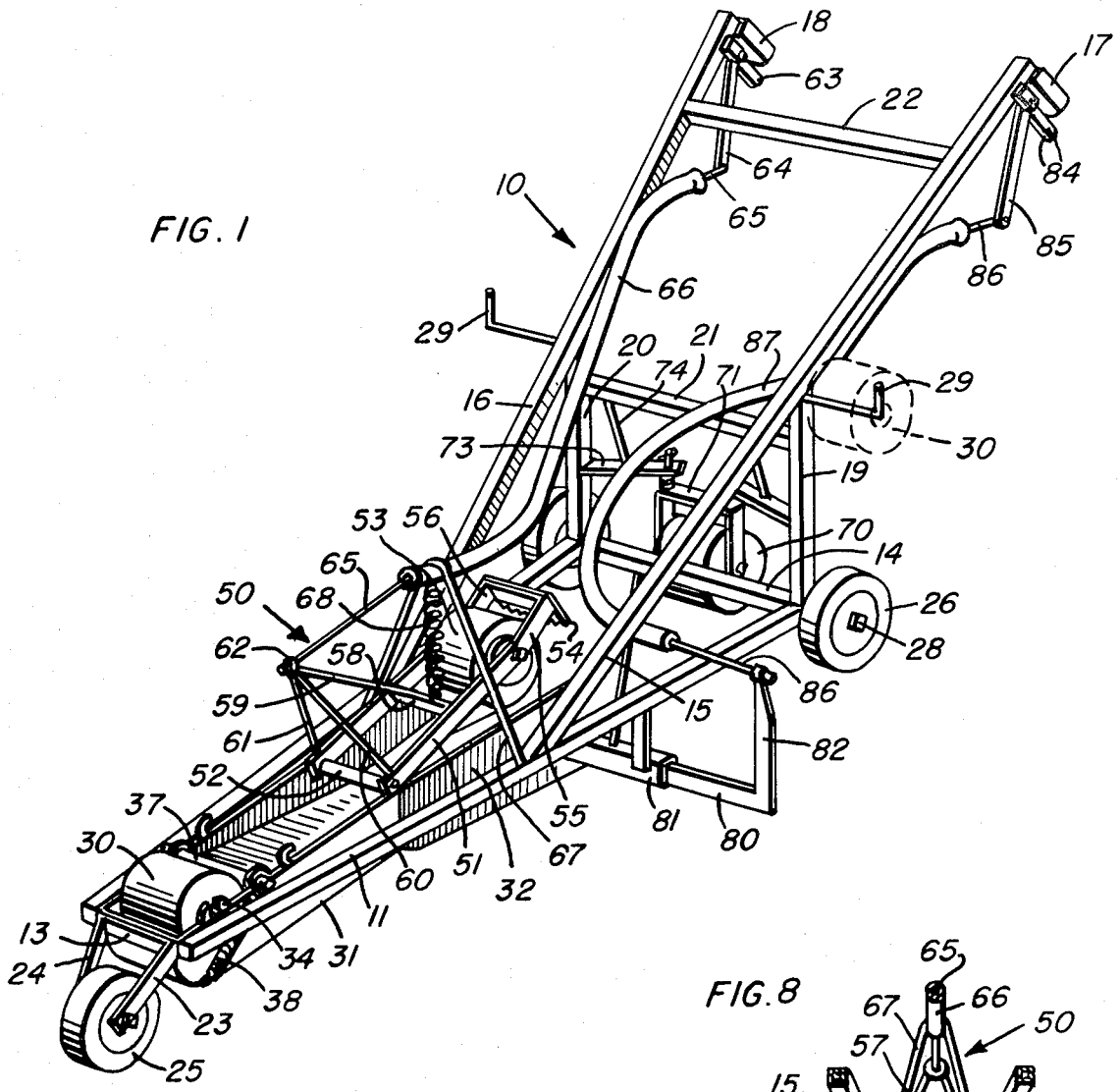
FIG. 1 is a perspective of my new roadway striper loaded with tape but before initial application of the tape to the surface.

In the following description of a preferred embodiment, like reference characters are used throughout the various views to designate like elements of the construction and it is understood that equivalent mechanical elements may be substituted as desired within the purview of those skilled in the art.

Figure 2:
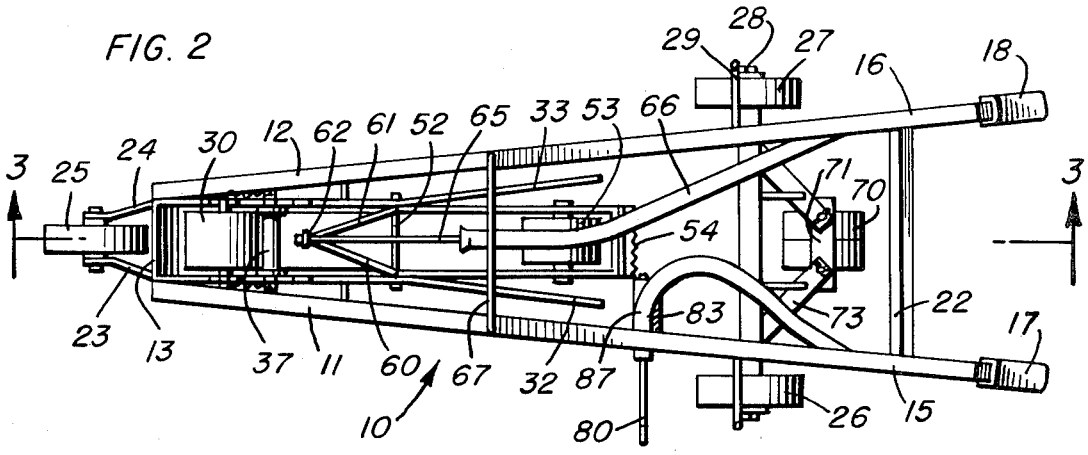
FIG. 2 is a plan view of the striper.

My roadway striper is shown generally at 10 and is formed in a skeletal frame comprising side frame members 11 and 12 which diverge from front to back as shown in FIG. 2 and are joined at the front by a short cross frame member 13 and at the rear by a larger cross frame member 14.

Handle riser frame members 15 and 16 are welded or otherwise secured to the side frame members about mid-span and are angled upwardly and rearwardly. They terminate in handle grip members 17 and 18. To add rigidity to the assembly, upstanding legs 19 and 20 connect between the ends of frame members 11 and 12 to the riser frames and the legs are joined by an upper rear cross shaft 21. A rigidifying handle spacer bar 22 is also provided adjacent to the handles to provide a stable rigid structure.

At the front of the striper are secured as by welding downwardly converging front wheel side arms 23 and 24 between which a rubber tired front guide wheel 25 is rotatably mounted in conventional fashion. At the rear, the striper is mounted for movement on main wheels 26 and 27. To this effect an axle 28 may extend through the hollow cross frame member 14. The striper may be easily propelled and steered with precision by the operator.

Optionally, one or more brackets 29 may extend from the handle riser frame members 15 and 16 for storage and ready replacement of extra rolls of roadway marking tape 30.

Figure 9:
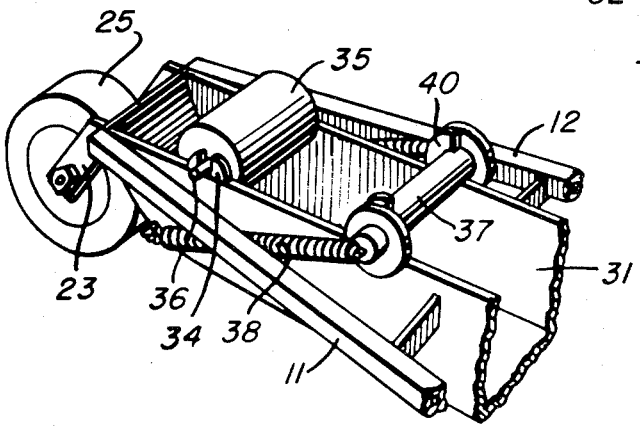
FIG. 9 is a cut-away rear perspective of the front portion of the striper showing the presser roll in its retracted locked position preparatory to placing a full spool of tape in position.

The forward lower portion of the striper is protected by a sheet metal lower casing 31 which includes diverging side wings 32 and 33. Mounted on the upper edge of each side of casing 31 are a pair of spool axle locating stubs 34 presenting an open top into which a spool 35 having opposed stub axles 36 may be placed. Such an empty spool is shown in FIG. 9, however it will be apparent that the spool may be inserted in a roll of adhesive back marking tape 30 as in FIG. 1. The tape can be any type of commercially available roadway marking tape which may be obtained in various colors and with light reflecting or luminescent features if desired.

In order to prevent free spooling and unraveling of the tape and to obtain proper unwinding tension, a flanged presser roll 37 is provided. Elongated coil springs 38 connected to the lower casing 31 and the presser roll axle 39 serve to hold the cylindrical surface of roll 37 in contact with the outer convolution of tape 30. Presser roll retainer lugs 40 are mounted on the upper edge of each side of casing 31 so that as shown in FIG. 9, the presser roll can be locked therein in an out-of-the-way position to allow spool 35 to be withdrawn and a new spool and roll of tape inserted. Thereafter, the presser roll may be released whereby under the action of the springs 38 it will remain in contact with roll 30 as shown in FIG. 1.

Mounted rearward of the spool on the striper frame is the pulling wheel-cutter assembly shown generally at 50. This assembly includes a support frame 51 formed of two side bars pivotally mounted on the casing top 31 by a cross pivot shaft 52. Journaled for rotation at the rear of frame 51 is a rubber tired pulling wheel 53. It should be understood that the wheel 53 is substantially as wide or wider as the tape to be applied. If desired, two or more smaller wheels may be mounted in tandem.

Figure 8:
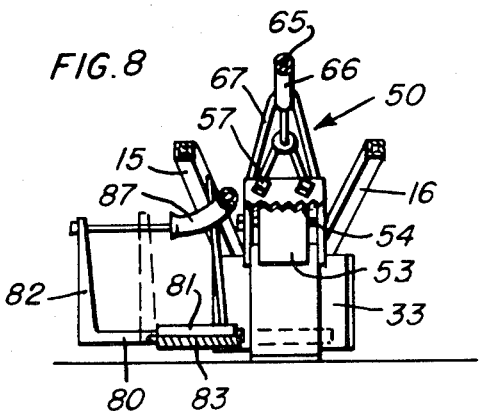
FIG. 8 is a cross-section taken along line 8—8 in FIG. 3 and showing in phantom lines the travel of the cutter bar as in FIG. 6.

A cutter blade 54, preferably of toothed or serrated configuration, is mounted rigidly to the shaft of pulling wheel 53 by means of upwardly angled side arms 55 and 56 and is of greater length than the tape width and extends transverse to the striper body and overlies the tape. The blade may be removable for sharpening or replacement by means of fasteners 57 (FIG. 8).

A cross brace 58 extends between the support side bars 51 forward of the pulling wheel. One leg 59 of a tripod brace including legs 60 and 61 is directed upwardly and forwardly from the center of brace 58. Legs 60 and 61 are welded to the front top edge of the side bars and all of the tripod legs meet at a point where they are joined to a short tube or grommet 62.

Figure 6:
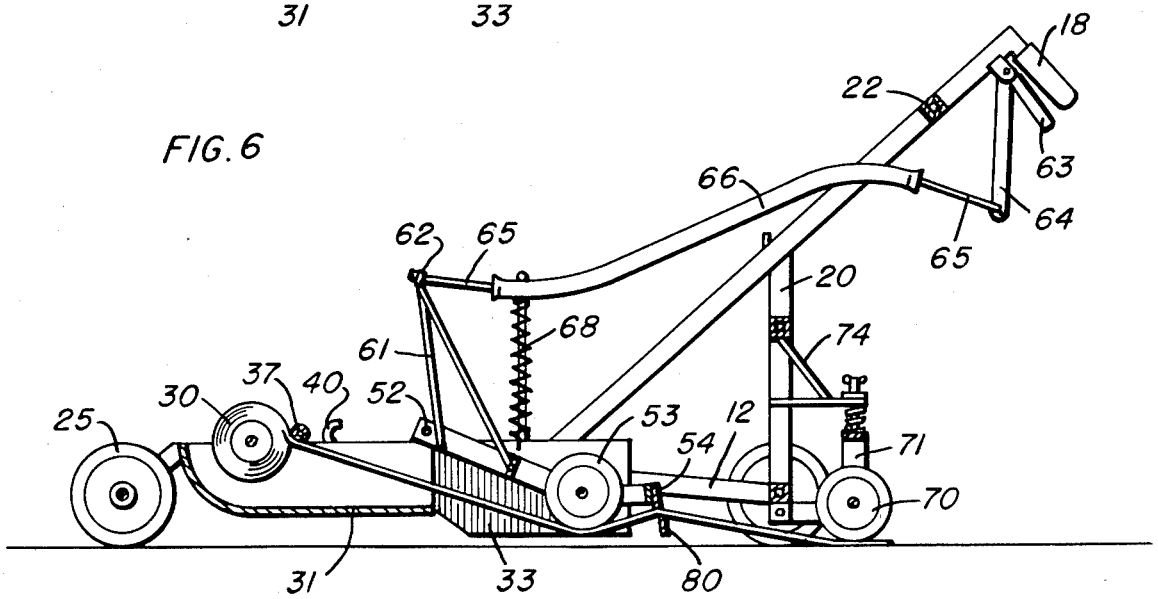
FIG. 6 is a view similar to FIG. 3 showing the pulling wheel and cutting blade lowered and cooperating with the slidable cutter bar to sever the tape.

For operation of the pulling wheel-cutter assembly 50, a bell crank 63 is fixed for pivotal movement on riser frame member 16 adjacent to handle grip 18. Arm 64 of the crank extends downwardly and a flexible wire cable 65 is secured thereto and passes through a rigid guide conduit 66 and the opposite end passes through and connects to the tripod brace grommet 62. The conduit 66 is secured to riser frame member 16 and its forward end spaced above the pulling wheel-cutter assembly 50 by braces 67. A return spring 68 connected between conduit 66 and cross brace 58 normally serves to retain the pulling wheel-cutter assembly 50 in the raised inoperative position as depicted in FIGS. 1, 3, 5, and 7. It will be understood that when the operator pulls up on bell crank 63, as in FIG. 4 and FIG. 6, the force will be transmitted by cable 65 to the tripod legs at grommet 62, thereby swinging the pulling wheel-cutter assembly clockwise about pivot shaft 52 as viewed from FIGS. 3–7, against the force of spring 68. Release of bell crank 63 will cause return of the assembly 50 to its raised position by virtue of the spring force. The sequential operation of the pulling wheel-cutter assembly 50 will be discussed further herein.

To ensure smooth wrinkle-free application of the tape to the roadway or other surface, a finishing wheel 70 having a width substantially the same as the pulling wheel 53 is provided. Here again several smaller tread width wheels in tandem may be employed and they are preferably rubber tired. Wheel 70 is mounted for rotation in a U-shaped support bracket 71. Wheel 70 must exert some force on the tape to smooth it as the wheel passes thereover, therefore bracket 71 is preferably spring biased downwardly. Springs 72 act against brackets 73 mounted on the legs 19 and 20 to achieve this effect. Additional support struts 74 are provided to add rigidity to brackets 73.

In order to sever the tape after a desired length has been applied, a reciprocal cutter bar 80 acts in conjunction with the previously described cutting blade 54. Bar 80 is slidably supported in a guide sheath 81 fixed on the striper frame. A cutter actuating leg 82 extends upwardly from one end of bar 80, the opposite free end being connected to a coil spring 83 which is also connected to the frame. The spring 83 serves to normally bias the cutter bar 80 into its inoperative position as shown in FIGS. 1, 2 and 8. When the bar 80 is reciprocated toward the center of the machine as later described and as shown in dotted lines in FIG. 8, it will be in the proper position below the tape for cooperation with the cutting blade 54 (see FIG. 6).

A cutter bar actuating bell crank 84 is mounted on handle riser frame member 15 below the handle grip 17. Arm 85 of the crank extends downwardly and a flexible wire cable 86 is secured thereto and passes through a rigid curved guide conduit 87. The opposite end of the cable 86 is secured to the actuating leg 82 near the top thereof. Upward movement of crank 84 toward handle grip 17 will tension cable 86 pulling the arm 82 and cutter bar 80 into operative position below the tape to be cut and extending the coil spring 83 so that release of the crank 84 will result in the return of the cutter bar 80 to the FIG. 1 position.

SEQUENCE OF OPERATION

Figure 3:
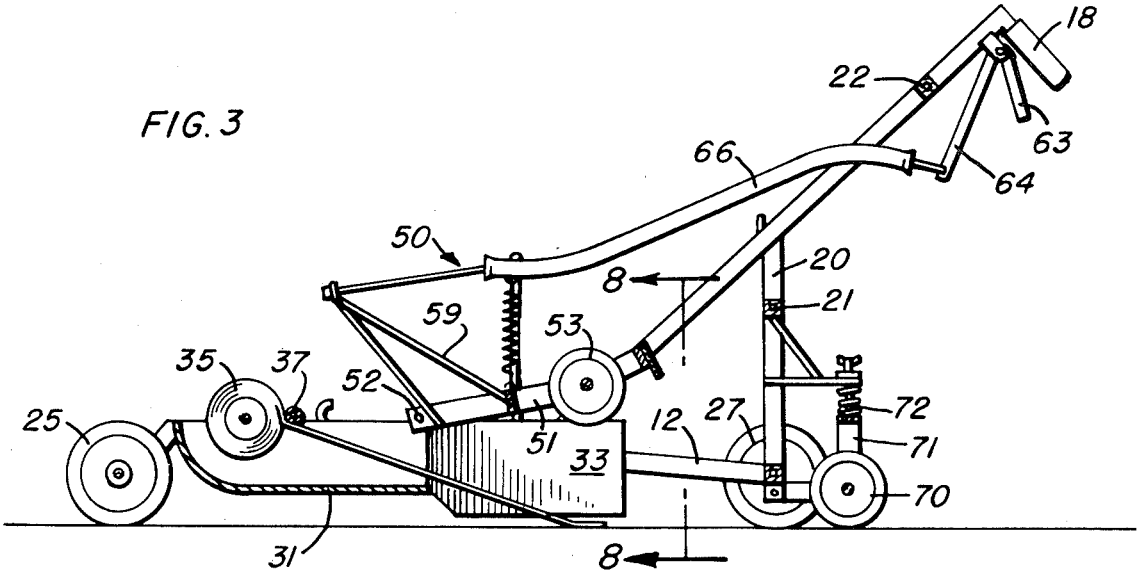
FIG. 3 is a section in elevation taken along lines 3—3 of FIG. 2 showing the start of operation with the pulling wheel in the raised position.
Figure 4:
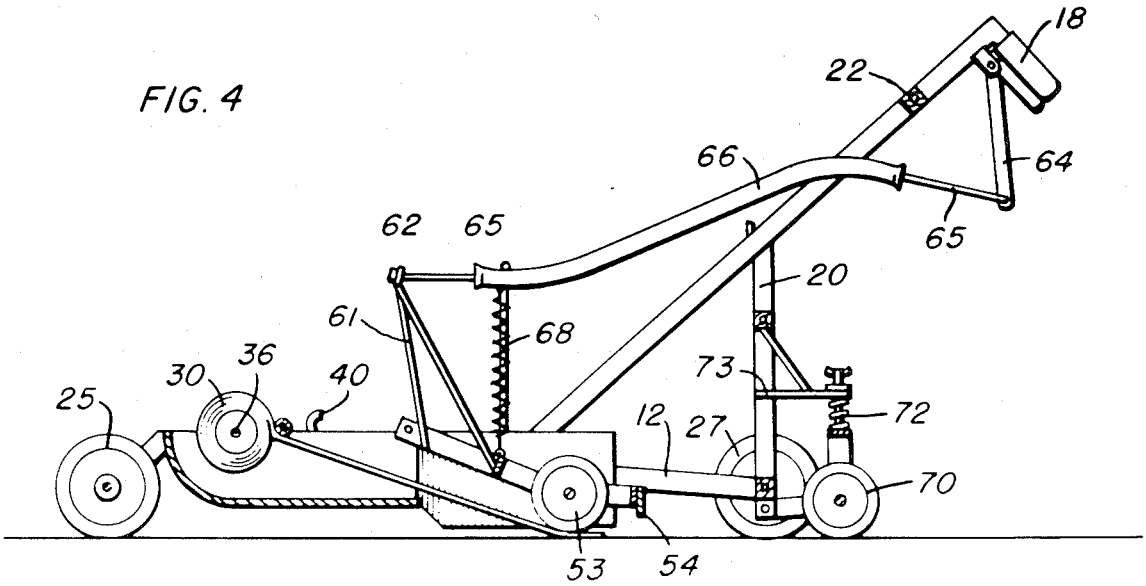
FIG. 4 is a view similar to FIG. 3 after actuation and lowering of the pulling wheel.
Figure 5:
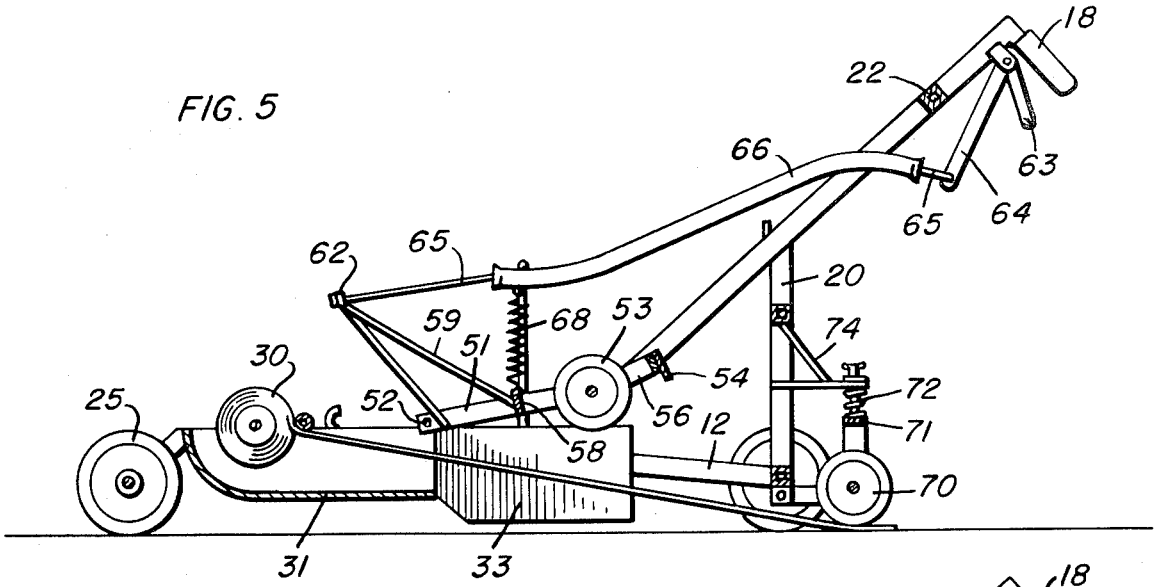
FIG. 5 is a view similar to FIG. 3 showing the pulling wheel in the raised position and the tape passing under the finishing wheel.

With a full understanding of the components of my roadway striper, the sequence of operation should be apparent. The machine is lined up manually on the roadway and a spool of tape is inserted between the locating stubs 34 and the presser roll placed in contact with the outer tape convolution. The tape is then hand fed until its end is below the pulling wheel 53 as shown in FIG. 3. At this point the bell crank 63 is engaged which moves the pulling-wheel cutter assembly 50 downwardly as in FIG. 4 so that pulling wheel 53 applies downward pressure on the tape. The striper is then put in forward motion and the tape will pay off of its spool due to the cooperation between the wheel 53 and the surface, it being understood that the crank 63 remains engaged during the machine's forward motion. As forward motion continues, the tape passes beneath the finishing wheel 70 which removes wrinkles and ensures smooth application.

Figure 7:
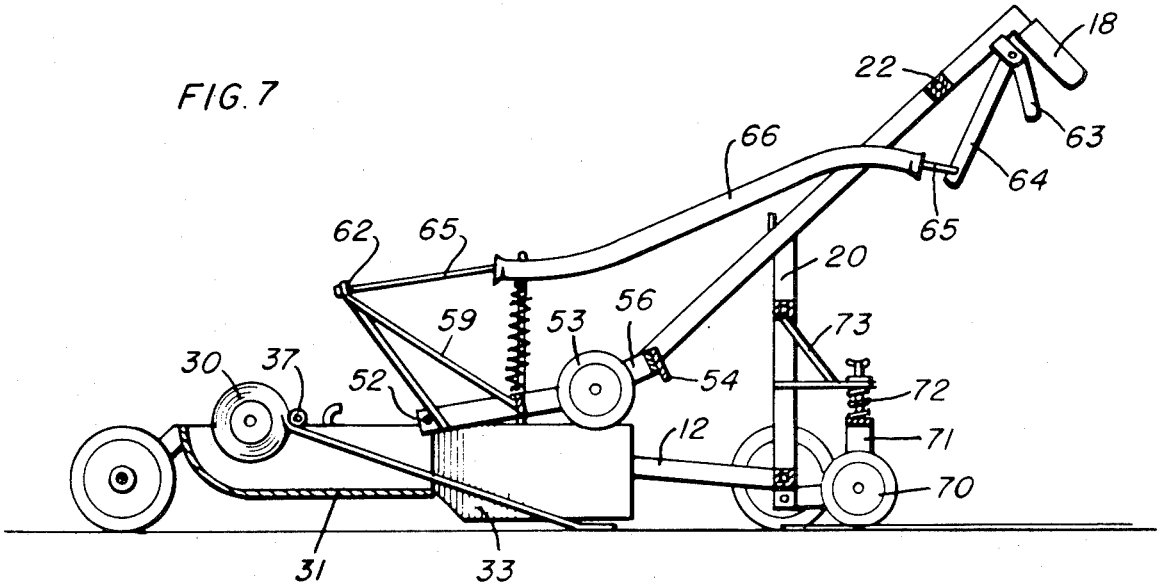
FIG. 7 is a view similar to FIG. 3 showing the pulling wheel again raised after severing at the end of strip application.

At the end of the desired strip application, forward movement is stopped and the crank 63 is released allowing the pulling-wheel cutter assembly 50 to return to its stowed position (FIG. 5) and leaving the tape suspended in taut condition between the spool and finishing wheel 70. At this time the crank 84 is applied moving the cutter bar beneath the tape and the crank 63 is again applied forcing the pulling-wheel cutter assembly downward so that the cutting blade 54 acts in conjunction with cutter bar 80 to sever the tape at this point. See FIG. 6. Both cranks are then released and the machine moved forwardly as in FIG. 7 until all of the applied tape has passed beneath the finishing wheel 70 (FIG. 7).

The operation is then complete with the tail of the tape dragging along the surface below the pulling wheel. To apply another strip, the operator merely engages again the crank 63 as described above and follows the sequence. It will be noted that a single long strip or a series of short spaced strips can be readily applied.

While the construction described is particularly applicable to a hand propelled roadway striper, it will be appreciated that the invention could also be incorporated on a self-propelled or towed striper as well. Further substitution of equivalent materials and mechanical movements well known in the art may be made within the scope of the invention defined by the claims.

I claim:

1. A portable, hand-propelled or towable machine for applying marking tape to a roadway or like surface comprising, an elongated framework, transport wheels supporting said framework on the surface to be marked, means on said framework near the front thereof to support a spool of marking tape, pulling wheel means mounted on said framework for vertical movement via manually actuated means between a raised stowed position and a lowered position pressing said tape against the said surface, cutting means extending substantially normal to the longitudinal center line of said framework and mounted thereon above the tape for vertical movement, and a cutter bar mounted on said framework below said cutting means and movable via manually actuated means from a stowed position lateral of said center line and of said tape into a fixed working position across and normal to said center line below said tape and cooperable with said cutting means to sever said tape, said cutting means being mounted on said pulling wheel means and moving vertically therewith.

2. A machine for applying marking tape as defined in claim 2 and further including spring means to normally maintain the cutting means and said pulling wheel means in the raised stowed position.

3. A machine for applying marking tape as defined in claim 2, and further including spring means for normally maintaining the cutter bar in its stowed position.

4. A machine for applying marking tape as defined in claim 3, and including handle push bars for propelling said machine, and bell cranks mounted on said push bars, each bell crank having a flexible cable connected thereto, the other end of said cable being connected to said pulling wheel means and said cutter bar respectively, whereby manual actuation of said bell cranks moves the respective pulling wheel means and cutter bar into operative positions.

5. A machine for applying marking tape as defined in claim 4, and further including guide tubes mounted on said framework, said flexible cables passing through said guide tubes.

6. A machine for applying marking tape as defined in claim 1, and further including a finishing wheel mounted for surface contact at the rear of said framework for rolling contact with tape already laid on the surface to smooth out any wrinkles therein.

7. A portable self-propelled roadway striper comprising a wheeled framework, tape spool support means on said framework near the front thereof, a pulling wheel-cutter assembly mounted on said framework for movement between an upper stowed position and a lowered operating position, said assembly including a pair of side frames pivotally mounted adjacent one end thereof to said framework, a pulling wheel journaled between said side frames, and a cutting blade mounted rearwardly of said pulling wheel, spring means mounted on said framework for normally urging said assembly into its stowed position, manually actuated means for pivoting said assembly into the operating position against the force of said spring means and against a tape trailing from a spool mounted on said spool support means, and a cutter bar mounted on and below said framework and movable laterally thereof from a stowed position lateral of said cutting blade and the tape to a fixed operative position to cooperate with said cutting blade, and manually actuated means on said framework to move said cutter bar.

8. A roadway striper as defined in claim 7, and further including second spring means on said framework normally urging said cutter bar to its stowed position.

9. A roadway striper as defined in claim 8, and further including a tape finishing wheel mounted on said framework adjacent the rear thereof for pressing the tape against the surface.

10. A roadway striper as defined in claim 7 and further including handle means on said framework for pushing said striper, said means for pivoting said assembly and said means to move said cutter bar being mounted on said handle means.

* * * * *